United States Patent [19]

Krämer

[11] 4,100,901

[45] Jul. 18, 1978

[54] FUEL INJECTION SYSTEM

[75] Inventor: Manfred Krämer, Schwieberdingen, Fed. Rep. of Germany

[73] Assignee: Robert Bosch GmbH, Stuttgart, Fed. Rep. of Germany

[21] Appl. No.: 650,734

[22] Filed: Jan. 20, 1976

[30] Foreign Application Priority Data

Jan. 21, 1975 [DE] Fed. Rep. of Germany ..... 2502159

[51] Int. Cl.[2] ..... F02M 39/00

[52] U.S. Cl. ..... 123/139 AW; 123/139 E

[58] Field of Search ..... 123/139 AL, 139 AW, 123/139 E, 28, 29; 60/39.28; 137/83, 431

[56] References Cited

U.S. PATENT DOCUMENTS

| | | | |
|---|---|---|---|
| 3,769,791 | 11/1973 | Lewis | 60/39.28 R |
| 3,844,265 | 10/1974 | Surace et al. | 123/139 E |
| 3,942,497 | 3/1976 | Schwartz | 123/139 AL |
| 3,967,607 | 7/1976 | Eckert | 123/139 AW |
| 4,018,200 | 4/1977 | Stumpp et al. | 123/139 AW |

*Primary Examiner*—Samuel Feinberg
*Attorney, Agent, or Firm*—Edwin E. Greigg

[57] ABSTRACT

A fuel injection system for internal combustion engines includes a fuel metering and distributing assembly. The pressure gradient across this assembly is controlled by an electromagnetic fluid pressure modulator which acts on one side of equal pressure diaphragm valves. The pressure gradient is monitored by a pressure-to-voltage transducer whose signal is fed to the modulator as a control signal. One or more of the diaphragm valves may be biased in the closing direction and the controlled pressure line may also include a pressure transformer.

11 Claims, 5 Drawing Figures

FUEL INJECTION SYSTEM

BACKGROUND OF THE INVENTION

The invention relates to a fuel injection system for mixture-compressing, externally ignited internal combustion engines. The system includes a fuel distribution unit and fuel metering valves whose flow cross section is changed in unison to determine the fuel quantity delivered to the injection valves. The fuel metering takes place at a pressure difference which is held constant by a valve inserted in the fuel flow downstream of the metering valve. This valve has two chambers separated by a resilient member which can alter its flow cross section. There is one such valve in each of the fuel supply lines for the cylinders of the engine and, in each case, the first valve chamber experiences the fuel pressure downstream of the metering valve in the sense of valve opening and at least one of the plurality of valves is a pressure equalizing valve.

Fuel injection systems of this type are used for the purpose of maintaining a constant pressure drop and, thus, a precise fuel metering which is independent of the pressures ahead of and downstream of the fuel metering unit.

In a known fuel injection system of this type, the fuel for the individual cylinders of the internal combustion engine is metering out in unison by a control edge of a control slide cooperating with a plurality of control ports.

The metering process takes place at a constant pressure difference, held constant by equal pressure valves and a differential pressure valve. While the pressure difference is normally constant, it is possible to alter it in dependence on motor parameters by means of an electromagnet. In the known system, the differential pressure valve adjusts the control pressure acting on the equal pressure valves. A fuel injection system of this type permits a direct intervention at the differential pressure valve.

OBJECT AND SUMMARY OF THE INVENTION

It is a principal object of the invention to provide a fuel injection system similar to the known above-described type which permits a simple and exact change of the differential pressure across the fuel metering valves without a great expense and while considering the requirements of operation of such a system.

This object is attained according to the invention, by providing an electrofluidic modulator which accepts signals representative of operational engine data and changes the pressure in the second chamber of one of the control valves in the system.

An advantageous embodiment of the invention provides that the second chambers of the equal pressure valves are joined and connected to the electrofluidic pressure modulator via a pressure transformer itself formed of two chambers separated by a resilient member. In a further advantageous embodiment of the invention, the surface of the transformer diaphragm facing the control pressure line has a larger cross section than that facing the second chambers of the equal pressure valves and the transformer contains a biassing spring. Yet another advantageous feature of the invention is that the pressure difference prevailing at the fuel metering valve assembly is sensed by a differential pressure sensor and is converted to an electrical potential by an appropriate transducer. This electrical potential is fed to an electronic controller which is part of the electrofluidic pressure modulator.

The invention will be better understood as well as further objects and advantages thereof become more apparent from the ensuing detailed description of two exemplary embodiments taken in conjunction with the drawing.

DESCRIPTION OF PREFERRED EMBODIMENTS OF THE INVENTION

Figure 1:
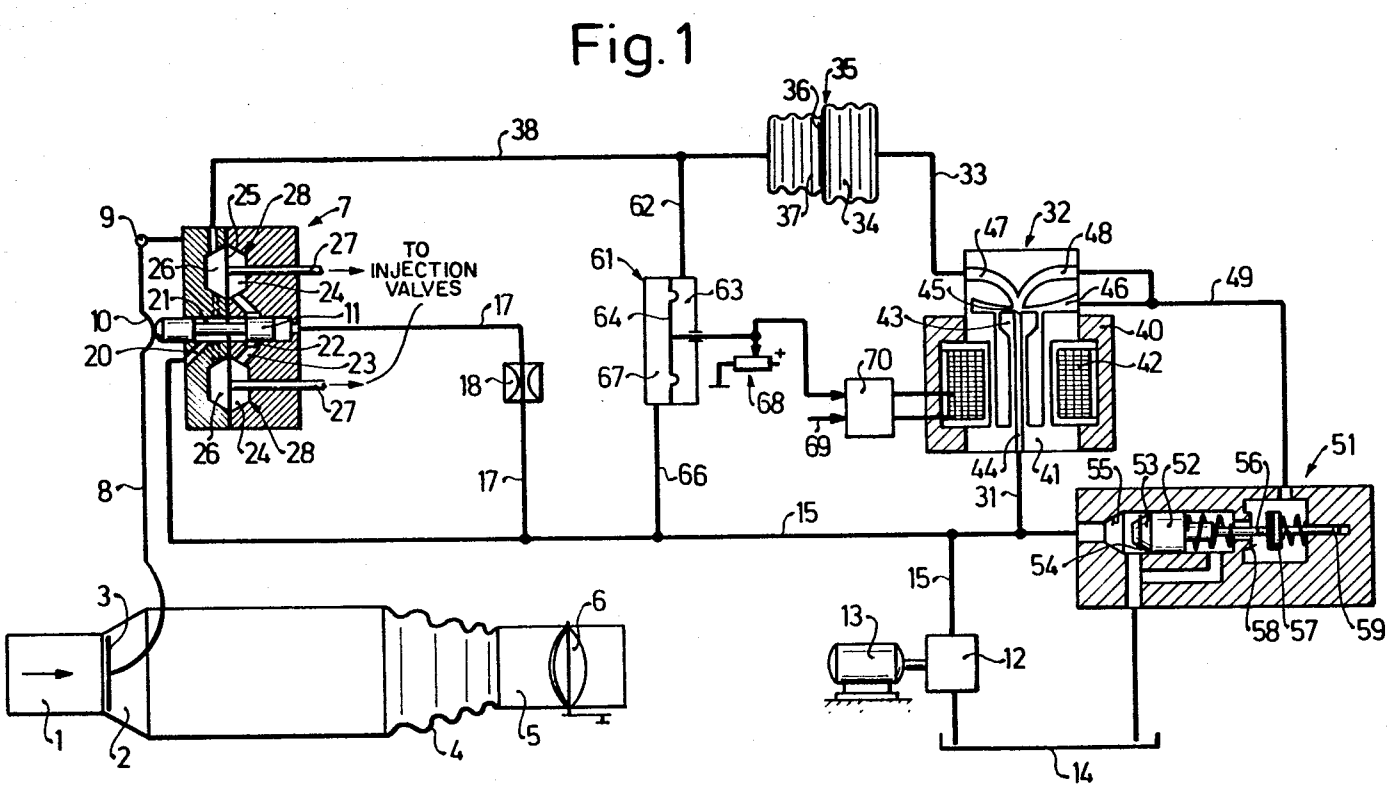
FIG. 1 is a schematic diagram of a first exemplary embodiment of a fuel injection system according to the invention.

Turning now to FIG. 1, there is shown a fuel injection system in which the air required for combustion flows in the direction of the arrow through an induction tube 1 adjacent to which there is a conical tube portion 2 including an air flow rate meter 3. The induction tube is extended by a connecting hose 4 and a section 5 in which there is disposed an arbitrarily actuatable throttle valve 6. The air continues to one of several cylinders (not shown) of the internal combustion engine.

The air flow rate meter is a plate disposed transversely to the air flow and pivotably movable within the conical region 2 of the induction tube as an approximately linear function of the air flow rate. If the resetting force acting on the flow rate meter 3 is constant and if the air pressure upstream of the flow rate meter 3 is also constant, then the pressure between the flow rate meter 3 and the throttle valve 6 remains constant as well.

The flow rate meter 3 directly controls a fuel metering and distribution valve assembly 7. The motions of the flow rate meter 3 are transmitted by a lever 8 freely pivotable about a point 9. A protrusion 10 moves the movable valve member 11 of the metering and distribution valve assembly 7. Fuel is supplied by a fuel pump 12 driven by an electric motor 13 which pumps fuel from a fuel container 14 through a supply line 15 to the metering and distribution assembly 7.

The control slide 11 is also engaged by a pressurized medium supplied through a line 17 containing a throttle 18 and serving as the restoring force on the flow rate meter 3.

From the fuel supply line 15, fuel flows through a channel 20 into an annular groove 21 on the control slide 11. Depending on the position of the control slide 11, the annular groove 21 opens control ports 22 each of which is connected through a channel 23 to a first chamber 24 of an equal pressure valve 28 embodied as a flat seat valve. From the various chambers 24, the fuel flows through individual channels 27 to the individual injection valves (not shown) which are located in the induction tube in the vicinity of the engine cylinders. A diaphragm 25 separates each chamber 24 from a second chamber 26.

Branching off from the supply line 15 is fuel line 31 leading to the input of an electrofluidic modulator 32 which has one output connected via a control line 33 to one cell 34 of a pressure transformer 35. The chamber 34 is separated from a cell 37 by a resilient transformer diaphragm 36. The cell 37 is connected with the various second chambers 26 of each of the equal pressure valves 28 by a line 38. In the present exemplary embodiment, the surface of the transformer diaphragm 36 which faces the cell 34 has a larger area than the surface facing the cell 37; as a consequence the pressure in cell 37 is greater than that in cell 34.

The electrofluidic modulator 32, referred to above, is of known construction including a permanent magnet 40, a core 41, a coil 42 and an armature 43. The armature 43 is penetrated by a pressure conduit 44 connected to the line 31 while its other end is supplied with a nozzle 45 which terminates in a recess 46. Disposed opposite the nozzle 45 are two outlet channels 47 and 48 which are embodied as diffusers and which are separated from one another by a flow divider. One of the diffusers is connected to the aforementioned control line 33 while the other is connected to a return line 49 which also communicates with the recess 46. A suitable electro-fluid modulator is described, e.g. in U.S. Pat. No. 3,774,644.

Located within the return line 49 is an overflow valve assembly 51 actuatable by a plunger-type pressure controller 52. The pressure controller 52 has a conical end region 53 on which is disposed an elastic sealing ring 54 and it cooperates with a conical valve seat 55 in the housing of the return flow valve 51. The control plunger 52 serves for setting the fuel pressure in the supply line 15 in such a manner that, when the fuel pressure increases beyond a predetermined value, fuel may flow back out of the supply line 15 to the fuel container 14. The control plunger 52 is urged in the closing direction by a spring and, during its opening motion, its pin 56 also opens the return flow valve 51 which has a valve disk 57, spring loaded in the closing direction, cooperating with a fixed valve seat 58. A guide pin 59 insures the axial movement of the valve disk 57. A differential pressure sensor 61 has a chamber 63 connected to the line 62 via line 38. The chamber 63 is closed off by a diaphragm 64 from a second chamber 67 connected via a line 66 to the fuel supply line 15. Thus, the pressure difference across the fuel metering assembly 7 is also present at the differential pressure sensor 61 so that a transducer, for example a potentiometer 68, may convert this pressure into an electrical potential which can be used, along with other operational parameters 69, to serve as the input of an electronic controller 70 which, in turn, controls the electrofluidic pressure modulator 32.

The method of operation of the fuel injection system depicted in FIG. 1, is as follows:

When the internal combustion engine is in operation, it aspirates air through the induction tube 1, 4 and 5, thereby causing the air flow rate meter 3 to experience a deviation from its normal position. Corresponding to this deviation, the lever 8 displaces the control slide 11 in the fuel metering and distribution assembly 7, thus metering out fuel to the injection valves of the engine. The direct connection between the flow rate meter 3 and the control slide 11 yields a constant ratio between the aspirated air quantity and the metered-out fuel inasmuch as the operating characteristics of these two elements are sufficiently linear which is the designed condition. However, to permit making the fuel-air mixture leaner or richer, depending on the operational domain of the engine, it is required to change the normally constant pressure difference across the metering valve elements 21, 22 in dependence on certain operational parameters of the engine, for example rpm, load, temperature or exhaust gas composition. This pressure difference, prevailing at the fuel metering locations 21, 22, is sustained by the equal pressure valve 28 and is alterable by the action of the electrofluidic modulator 32, acting via the pressure transformer 35, by changing the pressure prevailing in the various second chambers 26 of the equal pressure valve 28. The small pressure drop at the fuel metering locations 21, 22 requires the presence of the pressure transformer 35. The electrofluidic modulator 32 is controlled by an electronic controller 70. The superposition of the magnetic field generated by the coil 42, over the magnetic field due to the permanent magnet 40, causes a displacement of the elastically installed armature 43 from its normal position which, in turn, causes the fluid stream out of the nozzle 45 to create a corresponding pressure increase or decrease in the outlet channels 47, 48.

Figure 2:
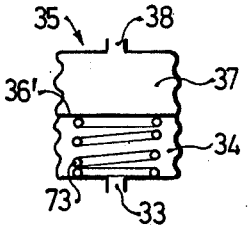
FIGS. 2 and 3 illustrate two variant embodiments of a pressure transformer according to the invention.

FIG. 2 is a detailed schematic picture of one exemplary embodiment of the pressure transformer 35 in which the surfaces of the transformer diaphragm 36′ facing the two cells 34 and 37 are of equal area, but in which a spring 73 biases the diaphragm 36′ in the direction of the primary pressure.

Figure 3:
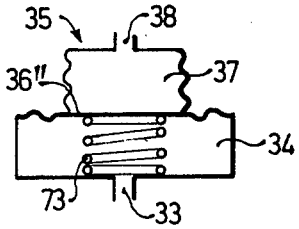

FIG. 3 is an illustration of a variant of the pressure transformer 35 where, in addition to the spring 73 in the cell 34, the area of the transformer diaphragm 36″ facing the cell 34 is larger than the area of the diaphragm facing the chamber 37.

Figure 4:
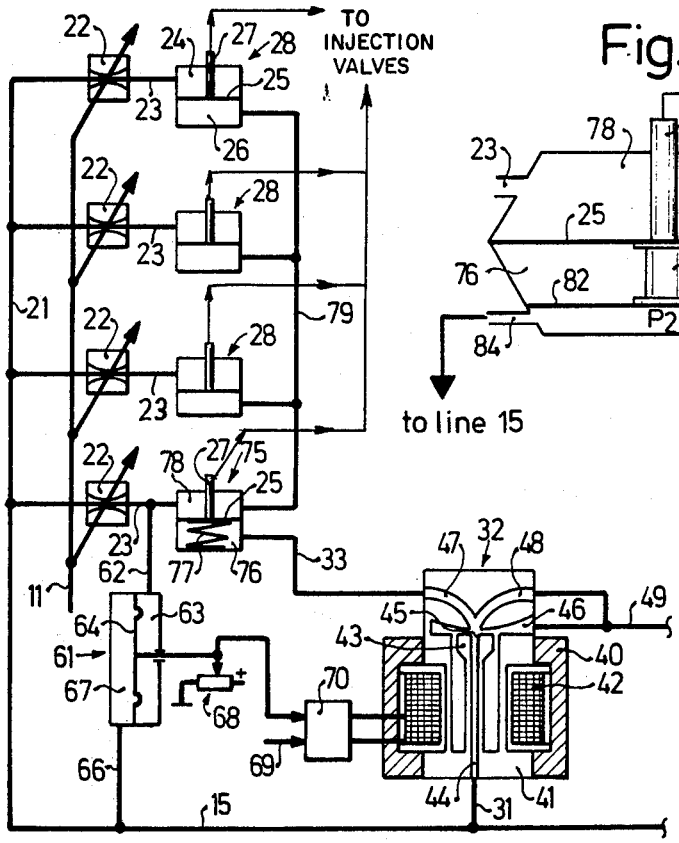
FIG. 4 is a schematic diagram of a second exemplary embodiment of the fuel injection system.

A second embodiment of the fuel injection system, according to the invention, suitable for a four-cylinder internal combustion engine, is shown in FIG. 4. Elements which are the same or similar to those in FIG. 1 retain the same reference numerals. By contrast to the exemplary embodiment shown in FIG. 1, the system illustrated in FIG. 4 includes a differential pressure valve 75 whose second chamber 76 is connected to the control line 33 of the electrofluidic converter 32 and includes a spring 77 which biasses the differential pressure valve 75 in the closing direction. The first chamber 78 of the differential pressure valve 75 is connected with the various second chambers 26 of the equal pressure line 28 through a common line 79. Due to the presence of the spring 77 in the chamber 76 of the differential pressure valve 75, the pressure transformer 35, previously required in the exemplary embodiment according to FIG. 1, is no longer necessary. The return line 49 also includes a return flow valve 51 (not shown here) which has a control plunger 52 and actuates the fuel return line 49 when the fuel pressure drops below a certain predetermined value.

Figure 5:
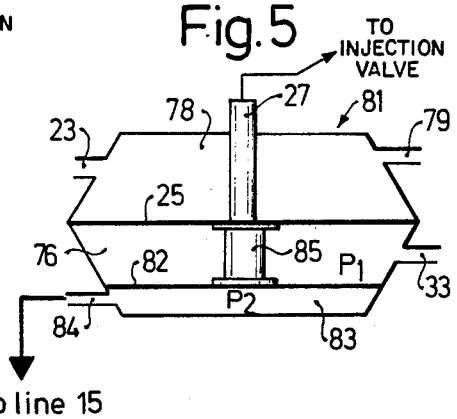
FIG. 5 is a schematic diagram of a differential pressure valve for use in the system.

The differential pressure valve 75, shown in FIG. 4, can also be embodied as a differential pressure valve 81, as shown in FIG. 5. In this valve, the second chamber 76 is connected, via the control line 33, with the electrofluidic modulator 32, while a transmission diaphragm 82 separates it from a third chamber 83 which is connected by a line 84 to the fuel supply line 15 and thereby experiences fuel pressure designated $p_2$. A mechanical member 85 couples the intermediate diaphragm 82 and the main diaphragm 25, and the effective area $A_2$ of the intermediate diaphragm 82 is smaller than the effective area $A_1$ of the main diaphragm 25.

Thus, when the pressure in the second chamber 76 is $p_1$, one may obtain a pressure difference $\Delta p$ across the fuel metering locations 21, 22 which obeys the formula:

$$\Delta p = (p_2 - p_1)\,[1 - (A_2/A_1)].$$

What is claimed is:

1. In a fuel injection system for internal combustion engines, said system including a fuel tank, a source of pressurized fuel, fuel injection valves and a fuel metering and distributing assembly for simultaneous metering of fuel to said injection valves, and further including diaphragm valves disposed between said distributing assembly and each of said injection valves, each of said diaphragm valves having a first and second chamber, said first chamber being exposed to fluid pressure downstream of said distributing assembly in the valve-opening sense, the improvement comprising:

a fluid pressure modulator with an outlet which is connected to said second chamber in at least one of said diaphragm valves, said pressure modulator having internal fluid passages and including electromagnetically actuated means for directing the flow of fluid selectively through said passages, thereby determining the static pressure at said outlet and in said second chamber for controlling the fluid pressure therein in dependence on engine data;

a pressure transformer connected between said second chambers and said pressure modulator; and each of said second chambers is connected in fluid communication with each other said second chamber.

2. A fuel injection system as defined by claim 1, in which said pressure transformer includes first and second cells separated by a resilient member, said first cell being connected to said second chambers in said diaphragm valve and said second cell being connected to the output side of said pressure modulator.

3. A fuel injection system as defined by claim 2, wherein said resilient member is an elastic membrane.

4. A fuel injection system as defined by claim 3, wherein the effective surface area of said elastic membrane is the same on both sides thereof, and wherein said second cell includes a spring which biases said elastic membrane; whereby the effective fluid pressure in said second chambers of said diaphragm valves is increased.

5. A fuel injection system as defined by claim 3, wherein the surface area of said elastic membrane facing said second cell is greater than that facing said first cell.

6. A fuel injection system as defined by claim 5, wherein said second cell includes a spring which biases said elastic membrane; whereby the effective fluid pressure in said second chambers of said diaphragm valves is increased.

7. A fuel injection system as defined by claim 1, the improvement further comprising a pressure regulator including a plunger valve, connected to said source of pressurized fluid and to said pressure modulator to provide for return-flow of fluid from said modulator to said fuel tank in pressure-dependent manner; thereby regulating the pressure in said source of pressurized fluid.

8. A fuel injection system as defined by claim 1, the improvement further comprising a bicameral pressure sensor connected between a location upstream of said fuel metering assembly and a location near said second chambers of said diaphragm valves and including potentiometric means for transducing pressure differences into an electrical signal which is fed to said electromagnetic fluid pressure modulator as a control signal.

9. In a fuel injection system for internal combustion engines, said system including a fuel tank, a source of pressurized fuel, fuel injection valves and a fuel metering and distributing assembly for simultaneous metering of fuel to said injection valves, and further including diaphragm valves disposed between said distributing assembly and each of said injection valves, each of said diaphragm valves having a first and second chamber, said first chamber being exposed to fluid pressure downstream of said distributing assembly in the valve-opening sense, the improvement comprising:

a fluid pressure modulator with an outlet which is connected to said second chamber in at least one of said diaphragm valves, said pressure modulator having internal fluid passages and including electromagnetically actuated means for directing the flow of fluid selectively through said passages, thereby determining the static pressure at said outlet and in said second chamber for controlling the fluid pressure therein in dependence on engine data; wherein said at least one of said diaphragm valves is embodied as a differential pressure valve including a biasing spring in its said second chamber which urges said diaphragm in the valve-closing direction, said second chamber being connected to said output of said electromagnetic fluid pressure modulator and said first chamber of said differential pressure valve being connected to said second chamber of each of the remaining ones of said diaphragm valves.

10. In a fuel injection system for internal combustion engines, said system including a fuel tank, a source of pressurized fuel, fuel injection valves and a fuel metering and distributing assembly for simultaneous metering of fuel to said injection valves, and further including diaphragm valves disposed between said distributing assembly and each of said injection valves, each of said diaphragm valves having a first and second chamber, said first chamber being exposed to fluid pressure downstream of said distributing assembly in the valve-opening sense, the improvement comprising:

a fluid pressure modulator with an outlet which is connected to said second chamber in at least one of said diaphragm valves, said pressure modulator having internal fluid passages and including electromagnetically actuated means for directing the flow of fluid selectively through said passages, thereby determining the static pressure at said outlet and in said second chamber for controlling the fluid pressure therein in dependence on engine data; wherein said at least one of said diaphragm valves is embodied as a differential pressure valve including a second chamber, said second chamber being connected to said output of said electromagnetic fluid pressure modulator, and further including a second diaphragm, defining a wall of said second chamber and also defining a third chamber which is connected to said source of pressurized fuel.

11. A fuel injection system as defined by claim 10, wherein said first chamber of said differential pressure valve is connected with each of said second chambers in the remaining ones of said diaphragm valves.

* * * * *